US005130060A

United States Patent [19]

Beseda et al.

[11] Patent Number: 5,130,060

[45] Date of Patent: Jul. 14, 1992

[54] METHOD OF MANUFACTURING POLYGLYCEROL ESTERS

[76] Inventors: Igor Beseda; Paul E. de Detrich, both of Unit 9, 51 Gould Street, Bondi, New South Wales, Australia, 2026

[21] Appl. No.: 549,424

[22] Filed: Jul. 6, 1990

Related U.S. Application Data

[60] Division of Ser. No. 219,399, Jul. 15, 1988, Pat. No. 4,950,441, which is a continuation-in-part of Ser. No. 895,470, Jul. 23, 1986, abandoned, which is a continuation of Ser. No. 552,388, Nov. 16, 1983, abandoned.

[30] Foreign Application Priority Data

Oct. 14, 1983 [AU] Australia ..... 20187/83

[51] Int. Cl.[5] ..... C11C 3/02

[52] U.S. Cl. ..... 554/168

[58] Field of Search ..... 260/410.6, 410.7

[56] References Cited

U.S. PATENT DOCUMENTS

| | | | |
|---|---|---|---|
| 4,010,183 | 3/1977 | Quesada | 260/410.7 |
| 4,169,102 | 9/1979 | Hameyer et al. | 260/410.7 |
| 4,209,431 | 6/1980 | Hameyer et al. | 260/410.7 |
| 4,722,811 | 2/1988 | Godwin | 260/410.6 |

*Primary Examiner*—Jose G. Dees
*Assistant Examiner*—Deborah D. Cair
*Attorney, Agent, or Firm*—Birch, Stewart, Kolasch & Birch

[57] ABSTRACT

A method for the rapid and uninterrupted single stage manufacture of polyglycerol esters comprising reacting a monoester of glycerine in the presence of an acidic catalyst and heat. The method can be practised in current reaction vessels of the vertical cylinder type. There is no need to draw off polyglycerol during the course of the reaction.

6 Claims, No Drawings

METHOD OF MANUFACTURING POLYGLYCEROL ESTERS

This application is a divisional of copending application Ser. No. 07/219,399 filed on Jul. 15, 1988, now U.S. Pat. No. 4,930,441 which was a continuation-in part of application Ser. No. 895,470 filed Jul. 23, 1986, now abandoned which was a continuation of application Ser. No. 552,388 filed Nov. 16, 1983, now abandoned.

BACKGROUND OF THE INVENTION

This invention relates to improvements in methods of manufacturing polyglycerol esters.

Current methods of manufacturing such esters commence with a fatty acid such as stearic acid, oleic acid and glycerine and use an interrupted two-stage reaction procedure. First, a polycondensation step is performed, the reaction stopped to remove surplus polyglycerol and then esterification is induced.

Thus in order to obtain the desired polyesters, it is necessary that glycerol be subjected to polycondensation by heating same up to 300° C. for 8 to 14 hours prior to esterification of an artificially reduced amount of the polyglycerol so formed with a larger amount of fatty acid. This latter procedure can take up to 10 hours in order to form partial esters of polyglycerols.

The reaction vessel typically used in the manufacture of polyglycerol esters is of the vertical cylinder type and has changed little for many years. It has been found that this reaction vessel produces a surplus of semi-products, typically polyglycerol, and that consequently it is not feasible to perform the above reaction sequence, namely polycondensation and esterification, to produce commercial quantities of polyglycerol esters, and an additional storage vessel for receiving the surplus of semi-product is required. Further, the aforementioned reaction sequence involves cooling the reaction vessel down after condensation to enable removal of the semi-product prior to reheating to commence the esterification process. These deficiencies greatly increase the time required to produce the polyglycerol esters desired and require costly handling and storage facilities coupled with the excessive consumption of energy in reheating the reaction vessel for esterification. Hence the cost of polyglycerol esters in this manner is considerably increased. On the other hand, if condensation is carried out so as to provide merely the aliquot amount of polyglycerol required to achieve the amount of final ester desired in the esterification stage, then polycondensation had to be performed in the lower half of the reaction vessel since only a relatively small amount of glycerine was required. In these circumstances, the kinetics of the reaction, the mass of water vapor formed by the condensation reaction, and the necessity to lift the water vapor from the lower half of the reaction vessel in order to distill out the water vapor, will further extend the reaction time by approximately 50%. This results in undesirable chemical and physical changes in the polyglycerol during the prolonged heating required.

If, on the other hand, condensation is performed utilizing the whole of the volume of the reaction vessel, as is currently the practice, a surplus of polyglycerol is produced and hence additional storage facilities, extra time of 8 to 14 hours in the polycondensation stage and up to 10 hours in the esterification stage is involved, as well as wasting large amounts of heating energy.

Polycondensation is currently conducted under the presence of an alkaline catalyst and expensive fatty acids are currently being used as the raw material for subsequent esterification. Hence, these further disadvantages of the current method in the manufacture of polyglycerol esters demonstrates the need for the present invention.

SUMMARY OF THE INVENTION

It is an object of the present invention to provide a novel method in the manufacture of polyglycerol esters. It is a further object of the present invention to perform the method utilizing current plant facilities and in particular current reaction vessels of the vertical cylinder type. It is a further object of the present invention to manufacture polyglycerol esters without the need to draw off and store polyglycerol during the course of the reaction.

In accordance with one aspect of the present invention therefore there is provided a method for the uninterrupted manufacture of polyglycerol esters reacting a monoester of glycerine in the presence of an acidic catalyst and heat.

In accordance with another aspect of the present invention there is provided a method for the uninterrupted manufacture of polyglycerol esters involving transesterification of a fat and glycerine in the presence of an alkaline catalyst followed by polycondensation using an acidic catalyst.

In accordance with a further aspect of the present invention there is provided a method for the uninterrupted single stage manufacture of polyglycerol esters which comprises reacting a glycerine and a monoglyceride in the presence of an acidic catalyst at a temperature in the range of about 100° C. to about 300° C., a vacuum of 0–28 inches and reaction time of up to about 15 hours until desired polyglycerol esters (depending on total amount of water collected) are obtained.

In accordance with a further form of the present invention there is provided a method for the uninterrupted single stage manufacture of polyglycerol esters which comprises reacting a glycerine and a fatty acid in the presence of an acid catalyst at a temperature in the range of about 100° C. to about 300° C., a vacuum of 0–28 inches and reaction time of up to 15 hours at esterification conditions until the acid number drops below 5 and until the desired polyglycerol ester (depending on total amount of water collected) is obtained.

In accordance with a further form of the present invention, there is provided a method wherein the reaction is carried out with the acidic catalyst of a mixture of $Me(OH)_2$ and $H_3PO_4$ resulting in approximately $ME(HPO_4)$ and $Me(H_2PO_4)_2$ at a temperature in the range of about 100° C. to about 300° C. and a vacuum of 0–28 inches until the desired polyglycerol ester is obtained wherein Me is a member selected from the group consisting of sodium, calcium and potassium.

The improvement of the present invention avoids the usual two-stage reaction sequence by a novel single stage reaction of glycerine with any source of fat, including monoglycerides or fatty acids or mixtures thereof, directly forming polyglycerol esters using an acidic catalyst comprising a mixture of sodium, calcium or potassium salts and phosphoric acid. Typically also calcium hydroxide is utilized.

By choosing a suitable catalyst mix, temperature, reaction time and vacuum in the manner set forth, the drawbacks which have been found in the previous methods of manufacturing polyglycerol esters are substantially eliminated.

DETAILED DESCRIPTION

There are four general formulae illustrating the reaction in accordance with the present invention and these are set out below. Each is present to some degree, the proportion of each relative to the others being variable according to the starting materials used and/or desired properties of the final product.

A.

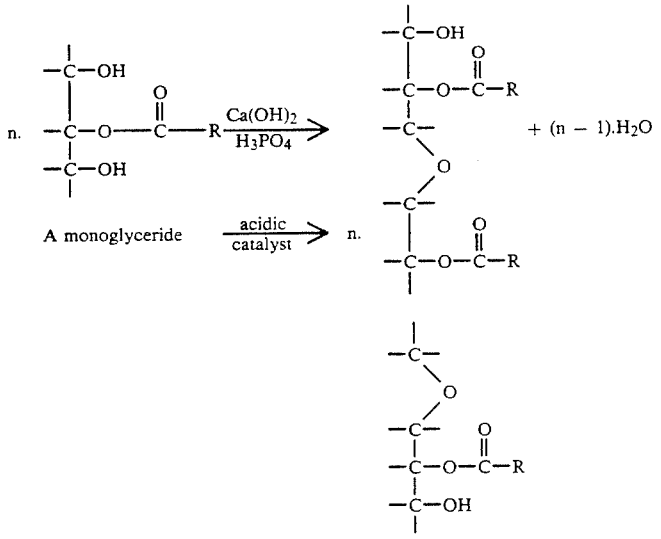

B.

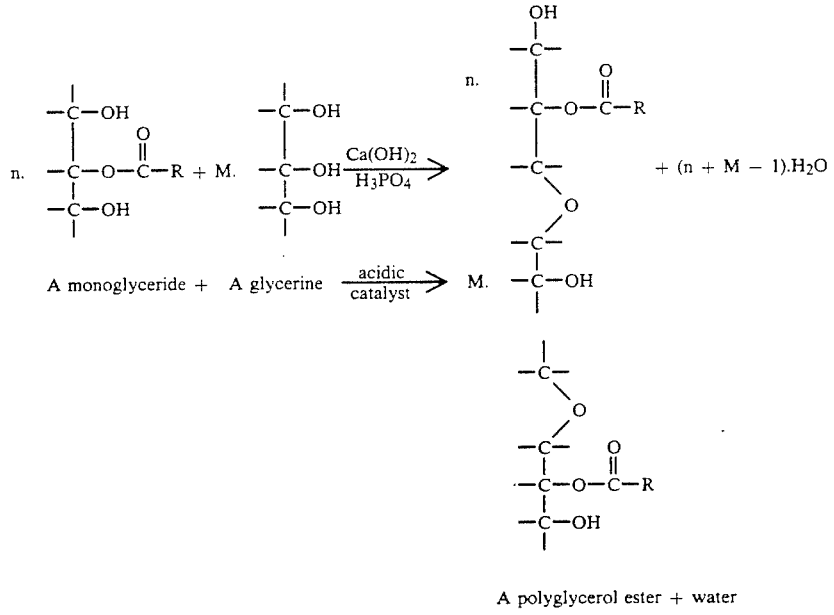

C.

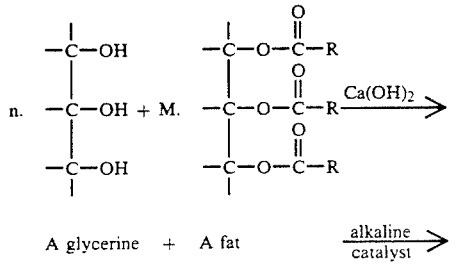

-continued

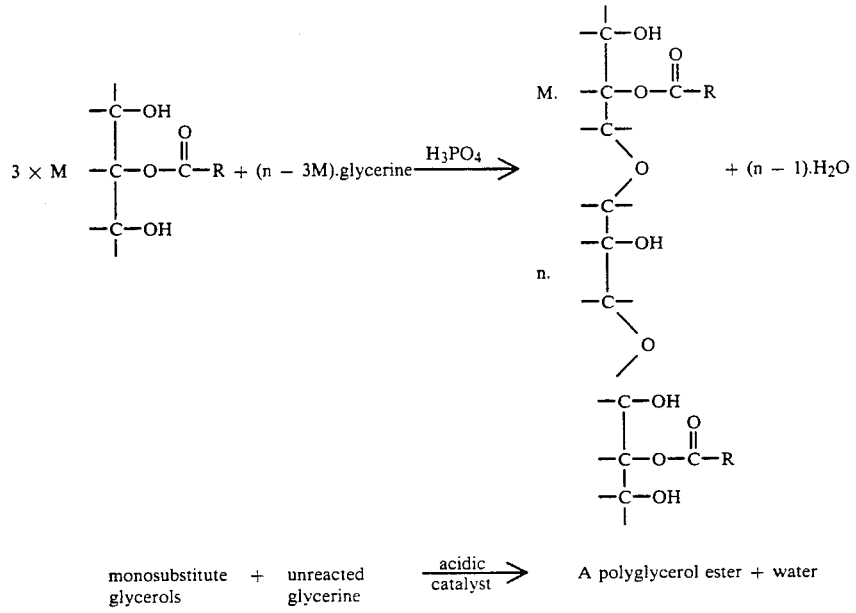

D.

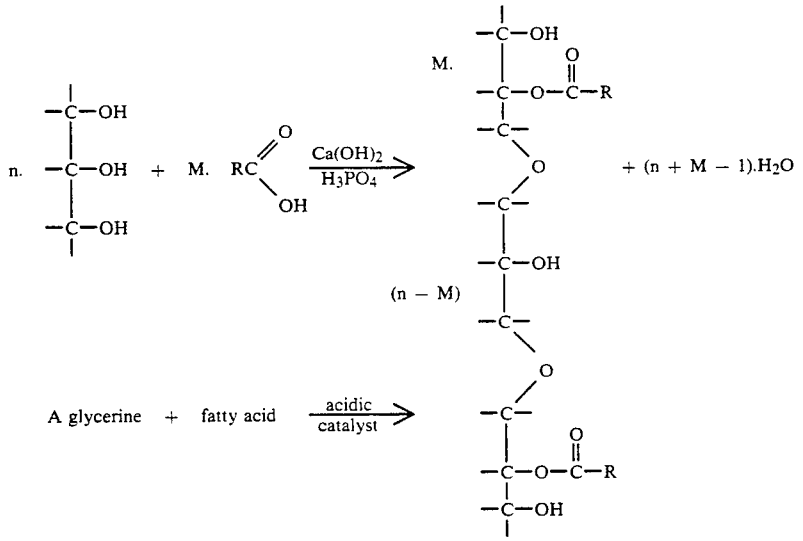

A polyglycerol ester + water

Due to a) shorter reaction time at higher temperatures, b) partial blocking of some of the free hydroxyl groups, c) spheric effect of a lone carbohydrate chain of an ester, and d) eliminating of esterification stage (except in Examples 6 and 7 —see below), the products prepared in this way, using an acidic catalyst, show on testing by high pressure liquid chromatograph—(HPLC) a remarkable decrease of cyclic polyglycerols. This is to be contrasted with a method which uses an alkaline catalyst.

Furthermore, the odor and color of these polyglycerol esters is much more acceptable.

PREFERRED EMBODIMENTS

The invention is further illustrated by reference to the following specific examples in all of which the procedure described is maintained as a continuous reaction.

EXAMPLE 1

Polycondensation of monoglyceride 3000 g of glycerine monostearate with 8 g of $Ca(OH)_2$ premixed with 52 g of water and 30 g of 25% $H_3PO_4$ premixed with 60 g of water were heated under vacuum of 25 inches up to 240° C. and reacted until desired amount of water was collected (to triglycerol, tetra glycerol or higher polyglycerols).

The polycondensed product was not monoester but mostly ester. Two free OH groups were left in each polymer.

EXAMPLE 2

Triglycerol monostearate

Preparation of partially esterified polyglycerol ester from glycerine and fat through monoglyceride stage with $Ca(OH)_2$ and $H_3PO_4$:

1461 g of stearine (hydrogenated oleo stearine) and 1100 g of glycerine plus 6 g of $Ca(OH)_2$ were heated under nitrogen blanket to 230°–240° C. and kept at this temperature for 2 hours. Then, to change the alkaline catalyst to the acidic catalyst, for safety reasons the batch was cooled down to 140° C. and 20 g of 25% $H_3PO_4$ premixed with 20 g of water was slowly added. Following this the batch was again slowly reheated with maximum vacuum of 26 inches and temperature of 240° C. without stopping the reaction. It was reacted for 8 hours until 220 g of total water was collected. The composition of polyglycerol was:

| | |
|---|---|
| glycerine | 18.0%–22.0% |
| triglycerine | 52.0%–62.0% |
| tetraglycerine | 18.0%–22.0% |
| pentaglycerine | 2.2%–2.8% |

EXAMPLE 3

Tetraglycerol monoglyceride 1350 g of stearine (hydrogenated oleo stearine) and 1518 g of glycerine were reacted in exactly same way as in Example 2. 6 g of $Ca(OH)_2$ (dry) was added and batch kept at 230° C. for two hours. Then, after the monoglyceride stage was reached on appropriate testing, 20 g of 25% $H_3PO_4$ premixed with 20 g of water and the temperature of the batch raised slightly to 240° C. and kept at maximum vacuum of 28 inches for 6 hours. 370 g of total this example but gas chromatograph testing demonstrated substantial tetraglycerol formation.

EXAMPLE 4

Triglycerol monostearate

Preparation of partially esterified polyglycerol ester from glycerine and monoglyceride with $Ca(OH)_2$ and $H_3PO_4$ catalyst:

1790 g of 90% glycerine monostearate premixed with 920 g of glycerine were heated under nitrogen blanket up to 100° C. The catalyst was prepared by dispersing 8 g of $Ca(OH)_2$ (dry) with 52 g of water and then 30 g of 25% $H_3PO_4$ premixed with 60 g of water was slowly added into it while stirring for 30 minutes. Such prepared catalyst mixture was added at 100° C. to glycerine monoglyceride. This reaction mixture was then heated up and nitrogen replaced with slow application of vacuum. At 120° C. and vacuum of 20 inches the first water started to come over. In 3 hours time 230° C. was reached at 23 inches of maximum vacuum and 160 g of water was removed. This condition was kept for another 3 hours and 310 g of total water was collected.

Composition of polyglycerol was similar as in Example 2.

EXAMPLE 5

Hexa glycerol monostearate 1432 g of 40% monostearate sold under the branch name PALSGATE 7116 and 1840 g of glycerine were treated with the same catalyst as in Example 4 and under similar conditions. In this case 450 g of total water was removed.

The composition of polyglycerol was:

| | |
|---|---|
| glycerine | 3.2–3.8% |
| diglycerine | 19.0–23.0% |
| triglycerine | 11.0–13.0% |
| tetraglycerine | 18.0–22.0% |
| pentaglycerine | 14.5–17.5% |
| hexane heptane | 24.0–29.0% |

EXAMPLE 6

Triglycerol monooleate

Preparation of partially esterified polyglycerol ester from glycerine and fatty acid with $Ca(OH)_2$ and $H_3PO_4$:

770 g of glycerine and 767 g of oleic acid were treated with catalyst prepared in a similar way as in Example 4. 4 g of $Ca(OH)_2$ (dry) premixed with 26 g of water and 15 g of 25% $H_3PO_4$ premixed with 30 g of water were added at room temperature. The batch was heated to 230° C. under 23 inches of maximum vacuum in 2 hours time and reacted for another 3 hours. 240 g of total water was collected.

The composition of polyglycerol was similar as in Example 4.

EXAMPLE 7

Tetraglycerol monooleate 1000 g of glycerine and 767 g of oleic acid were reacted with the same catalyst and in similar way as in Example 6 until 260 g of total water was collected after 3 ½–4 hours.

Notes referring to all examples:

a) Reproducability and composition of polyglycerols depends on rate of heating and increasing of vacuum in the reaction vessel. In all experiments the vapor temperature was kept at 100° to 105° C.

b) Due to the semi-acidic catalyst condition, the soap value of all polyglycerol esters prepared by this method was nil. In order to achieve a specific property the soap value has to be adjusted at the end of reaction (after total water was collected) by adding sodium hydroxide or sodium carbonate.

c) It is known that physical and chemical properties of such partial esters of polyglycerols, particularly with respect to their oil, water and solvent solubility depend on both the polyglycerol and the acid. They become more hydrophilic as the molecular weight of the polyglycerol increases and become less hydrophilic as the length of the aliphatic chain of the acid used in the esterification is increased.

It is also known that the polyglycerol esters based on higher polyglycerols (penta, hexa deca) show greater affinity to water than the glycerol ester. It therefore becomes possible to synthesize an entire class of emulsifiers, tailor-made, to perform any specific function ranging from complete oil solubility to complete water solubility.

It is possible with the method of the invention to prepare such tailor-made polyglycerol esters by simply controlling the total water collected; rate of heating and increasing of vacuum up to the maximum vacuum. This depends on the type of reaction vessel.

Thus it will be obvious to those skilled in the art that many modifications may be within the scope of the present invention without departing from the spirit thereof, and the present invention is to be restricted only in accordance with the appended claims.

We claim:

1. A single stage method for the manufacture of polyglycerol esters comprising reacting a monoester of glycerine with glycerine in the presence of an acidic catalyst and heat.

2. The method of claim 1 wherein said acidic catalyst is a mixture of a sodium salt, a potassium salt, sodium hydroxide, or potassium hydroxide, together with phosphoric acid.

3. The method for the manufacture of polyglycerol esters of claim 1 wherein the reaction is carried out with the acidic catalyst of a mixture of $H_3PO_4$ and a hydroxide selected from the group consisting of sodium hydroxide, calcium hydroxide and potassium hydroxide resulting in approximately either $Ca(H_2PO_4)_2$ plus $CaHPO_4$ or $NaH_2PO_4$ plus $Na_2HPO_4$ or $KH_2PO_4$ plus $K_2HPO_4$ at a temperature in the range of about 100° C. to about 300° C. and a vacuum of 0–28 inches until the desired polyglycerol ester is obtained.

4. The method for the manufacture of polyglycerol esters of claim 3, wherein the reaction time is about 15 hours.

5. The method of claim 2 wherein the sodium salt is sodium carbonate.

6. The method of claim 2 wherein the potassium salt is potassium carbonate.

* * * * *